US011426791B2

(12) United States Patent
Iwasaki et al.

(10) Patent No.: US 11,426,791 B2
(45) **Date of Patent: *Aug. 30, 2022**

(54) METHOD FOR PRODUCING METAL POWDER

(71) Applicant: SHOEI CHEMICAL INC., Tokyo (JP)

(72) Inventors: Mineto Iwasaki, Tosu (JP); Tetsuya Kimura, Tosu (JP)

(73) Assignee: SHOEI CHEMICAL INC., Tokyo (JP)

( * ) Notice: Subject to any disclaimer, the term of this patent is extended or adjusted under 35 U.S.C. 154(b) by 148 days.

This patent is subject to a terminal disclaimer.

(21) Appl. No.: 16/461,739

(22) PCT Filed: Nov. 9, 2017

(86) PCT No.: PCT/JP2017/040351

§ 371 (c)(1),
(2) Date: May 16, 2019

(87) PCT Pub. No.: WO2018/092664

PCT Pub. Date: May 24, 2018

(65) Prior Publication Data

US 2019/0314893 A1 Oct. 17, 2019

(30) Foreign Application Priority Data

Nov. 16, 2016 (JP) ..... JP2016-223134

(51) Int. Cl.
*B22F 9/30* (2006.01)
*B22F 9/24* (2006.01)
(Continued)

(52) U.S. Cl.
CPC ..... *B22F 1/16* (2022.01); *B22F 9/24* (2013.01); *B22F 9/30* (2013.01); *C23D 5/02* (2013.01);
(Continued)

(58) Field of Classification Search
CPC ..... B22F 1/02; B22F 9/30; B22F 2301/15; B22F 2301/35; B22F 2302/25;
(Continued)

(56) References Cited

U.S. PATENT DOCUMENTS 6,060,165 A * 5/2000 Asada ..... B22F 1/02 428/403
6,679,938 B1 * 1/2004 Kim ..... B22F 9/026 75/365
(Continued)

FOREIGN PATENT DOCUMENTS

CN 1184725 A 6/1998
CN 1200967 A 12/1998
(Continued)

OTHER PUBLICATIONS

Zhang, et al. "A thermodynamic assessment of the BaO—MgO, BaO—CaO, BaO—Al2O3 and BaO—SiO2 systems," Aalto University (Year: 2014).*
(Continued)

*Primary Examiner* — Sally A Merkling
*Assistant Examiner* — Dean Mazzola
(74) *Attorney, Agent, or Firm* — Alleman Hall Creasman & Tuttle LLP

(57) ABSTRACT

A method for producing a metal powder provided on the surface thereof with a glassy thin film, wherein a glassy substance is produced in the vicinity of the surface of the metal powder by spray pyrolysis from a solution that contains a thermally decomposable metal compound and a glass precursor that produces a glassy substance that does not form a solid solution with the metal produced from the metal compound by thermal decomposition, so as to form the metal powder provided on the surface thereof with the glassy thin film. The glass precursor is prepared such that the
(Continued)

melting temperature $Tm_M$ of the metal and the liquid phase temperature $Tm_G$ of the mixed oxide of the glassy substance satisfy the following formula (1):

$$-100\ [°\ C.] \leq (Tm_M - Tm_G) \leq 500\ [°\ C.] \quad (1).$$

9 Claims, 11 Drawing Sheets

(51) Int. Cl.
*C23D 5/02* (2006.01)
*B22F 1/16* (2022.01)

(52) U.S. Cl.
CPC ..... *B22F 2201/01* (2013.01); *B22F 2301/15* (2013.01); *B22F 2301/35* (2013.01); *B22F 2302/25* (2013.01); *B22F 2302/256* (2013.01)

(58) Field of Classification Search
CPC ..... B22F 2302/256; B22F 2302/35; B22F 2303/20; B22F 2201/01; B22F 2201/013; B22F 2201/40; B22F 1/16; B22F 9/026; B22F 9/08; B22F 9/18; B22F 9/20; B22F 9/22; B22F 9/24; B22F 2201/016; C23D 5/02; C22C 33/0235
See application file for complete search history.

(56) References Cited

U.S. PATENT DOCUMENTS

| | | | | |
|---|---|---|---|---|
| 2002/0122942 | A1 | 9/2002 | Aichele et al. | |
| 2003/0124043 | A1 | 7/2003 | Yadav et al. | |
| 2005/0056347 | A1* | 3/2005 | Takaya | H01F 1/20 148/306 |
| 2005/0262966 | A1* | 12/2005 | Chandler | C09K 11/671 75/331 |
| 2010/0101637 | A1 | 4/2010 | Yamasaki et al. | |

FOREIGN PATENT DOCUMENTS

| | | | | |
|---|---|---|---|---|
| CN | 1214979 | A | | 4/1999 |
| CN | 101920180 | A | | 12/2010 |
| CN | 102119063 | A | | 7/2011 |
| CN | 105050757 | A | | 11/2015 |
| JP | S6331522 | B2 | | 6/1988 |
| JP | H06172802 | A | | 6/1994 |
| JP | H06279816 | A | | 10/1994 |
| JP | H09256005 | A | | 9/1997 |
| JP | H10330802 | A | | 12/1998 |
| JP | H1171601 | A | | 3/1999 |
| JP | H11124602 | A | | 5/1999 |
| JP | 2003049203 | A | | 2/2003 |
| JP | 2007126750 | A | | 5/2007 |
| JP | 2014192454 | A | | 10/2014 |
| KR | 20140100347 | A | | 8/2014 |
| KR | 20140100347 | A | * | 8/2014 |
| WO | 2005015581 | A1 | | 10/2006 |

OTHER PUBLICATIONS

Cortez et al. "Fe—Ni Alloy Synthesis Based on Nitrates Thermal Decomposition Followed by H2 Reduction," Metallurgical and Materials Transactions B, vol. 45B, pp. 2033-2039 (Year: 2014).*
European Patent Office, Extended European Search Report Issued in Application No. 17871688.3, dated May 28, 2020, Germany, 8 pages.
ISA Japan Patent Office, International Search Report Issued in Application No. PCT/JP2017/040351, dated May 24, 2018, WIPO, 4 pages.
Dojin,"Molecular solids and covalent bond networks, ceramics, glass", Inorganic Chemistry Lecture, Department of Applied Chemistry, School of Engineering, University of Fukui, Jul. 2013, 28 pages.
European Patent Office, Extended European Search Report Issued in Application No. 17871386.3, dated May 28, 2020, Germany, 10 pages.
ISA Japan Patent Office, International Search Report Issued in Application No. PCT/JP2017/040352, dated May 24, 2018, WIPO, 4 pages.

* cited by examiner

[Fig. 1]
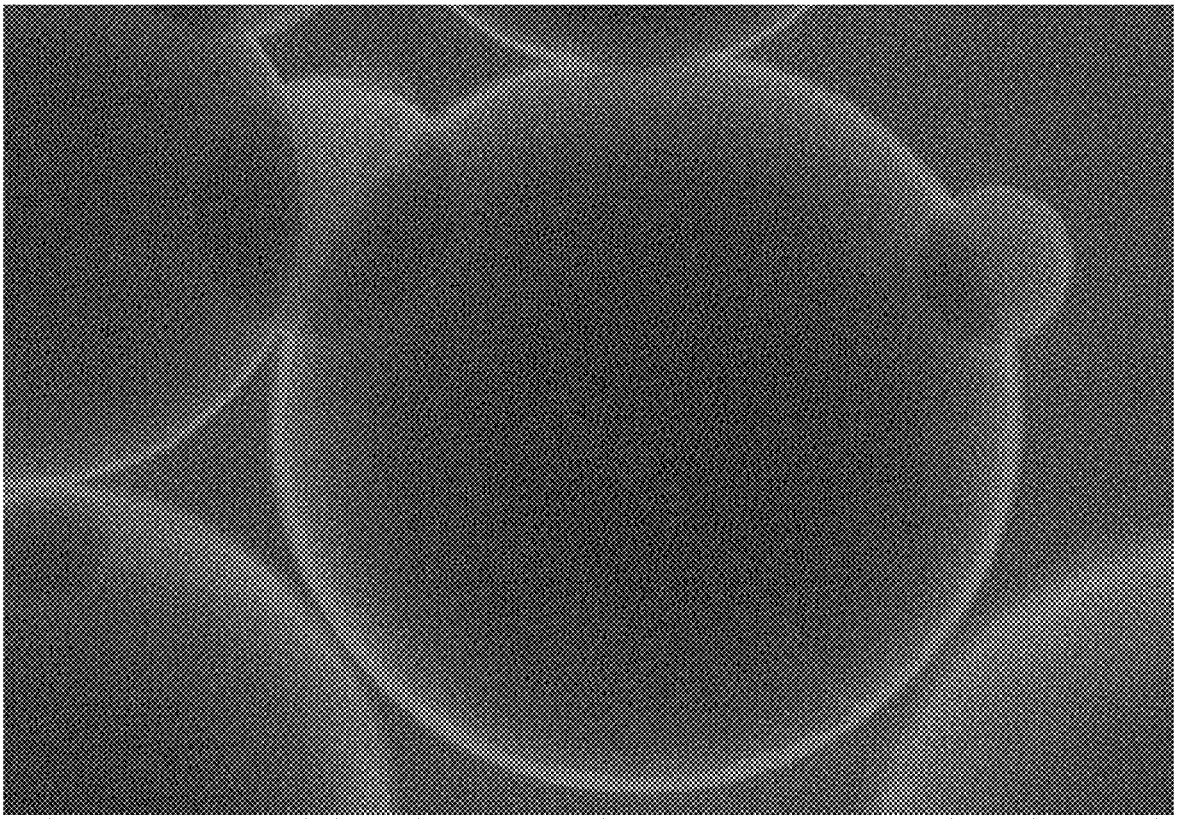

[Fig. 2]
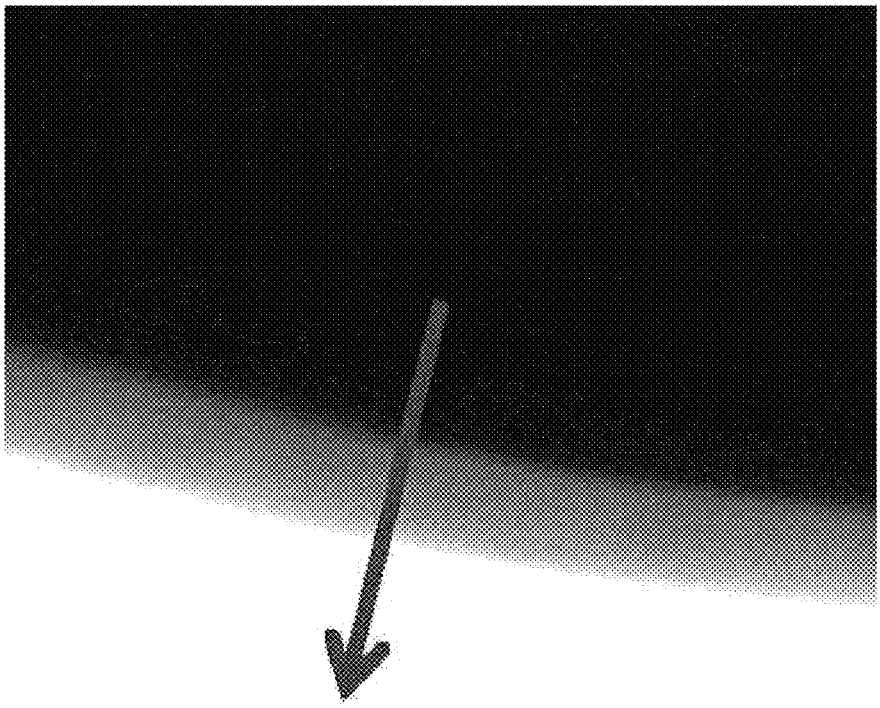

[Fig. 3]
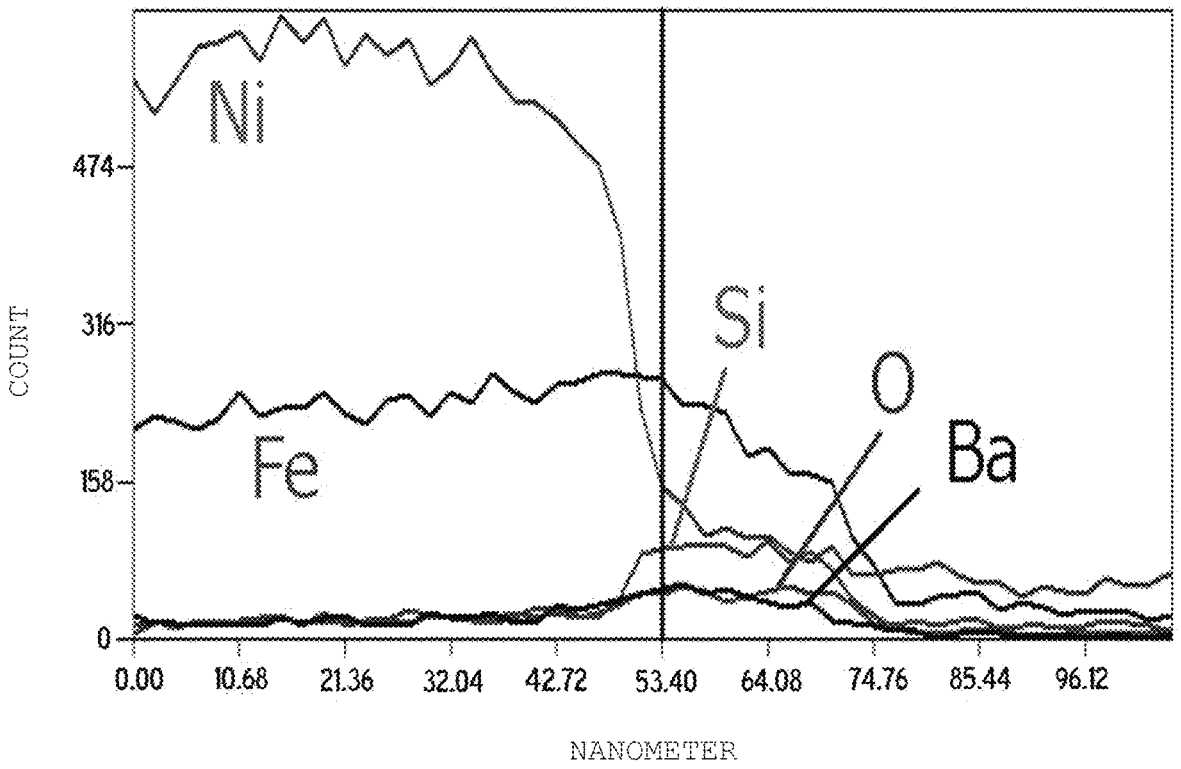

[Fig. 4]
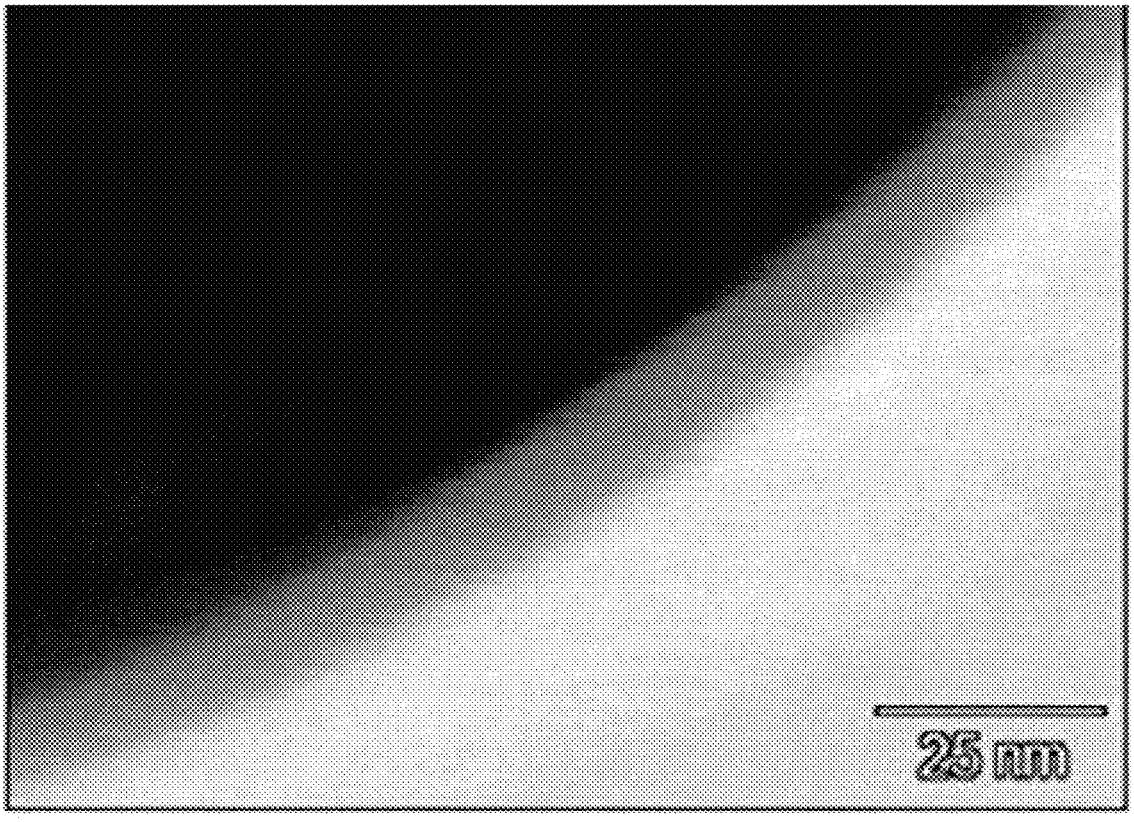

[Fig. 5]
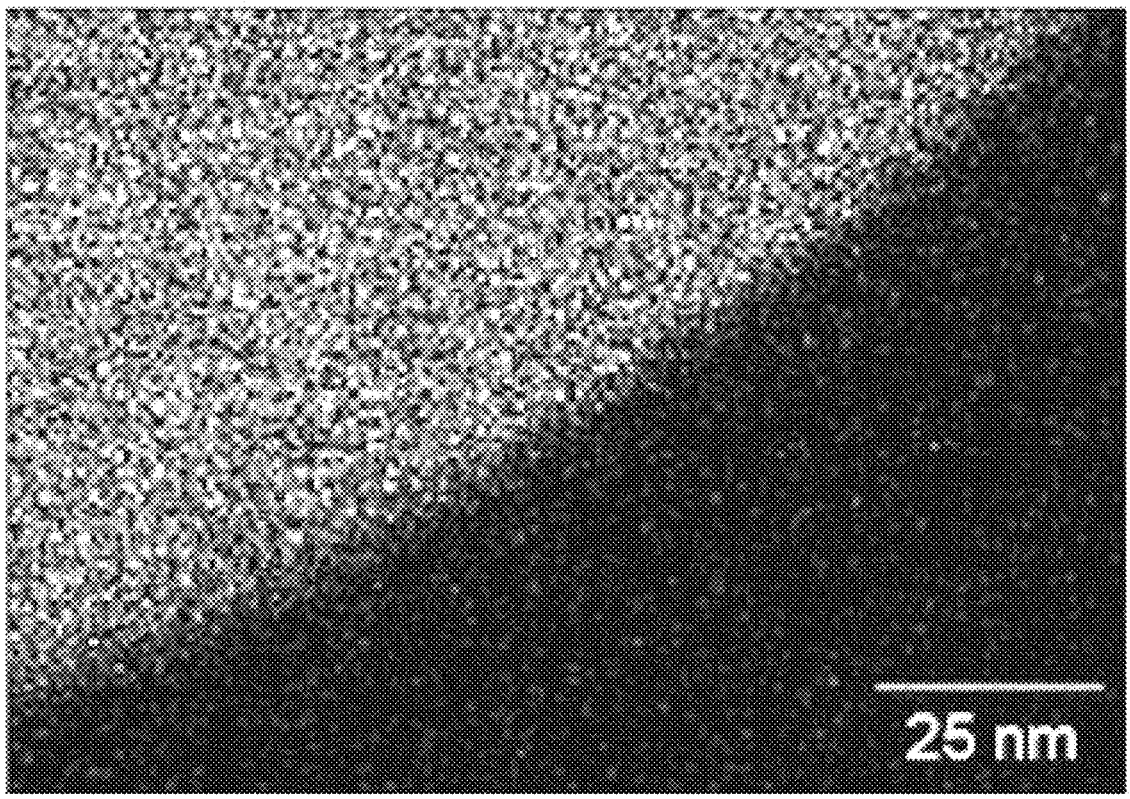

[Fig. 6]
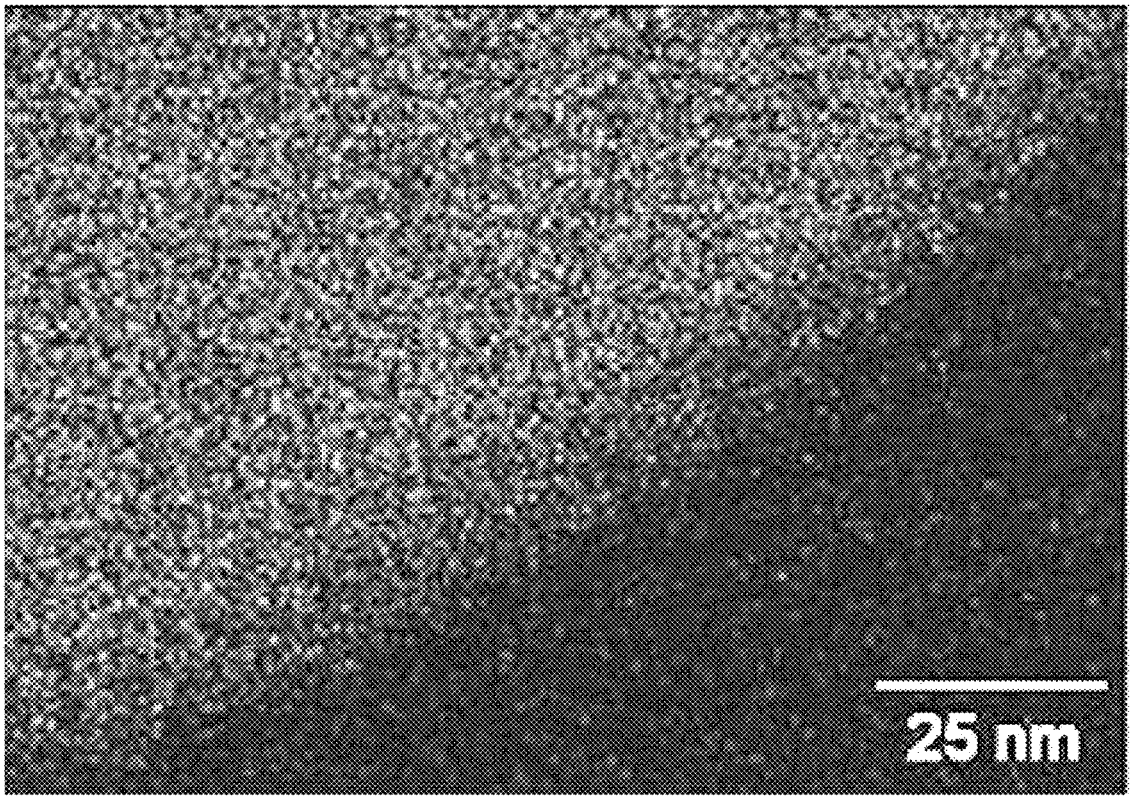

[Fig. 7]
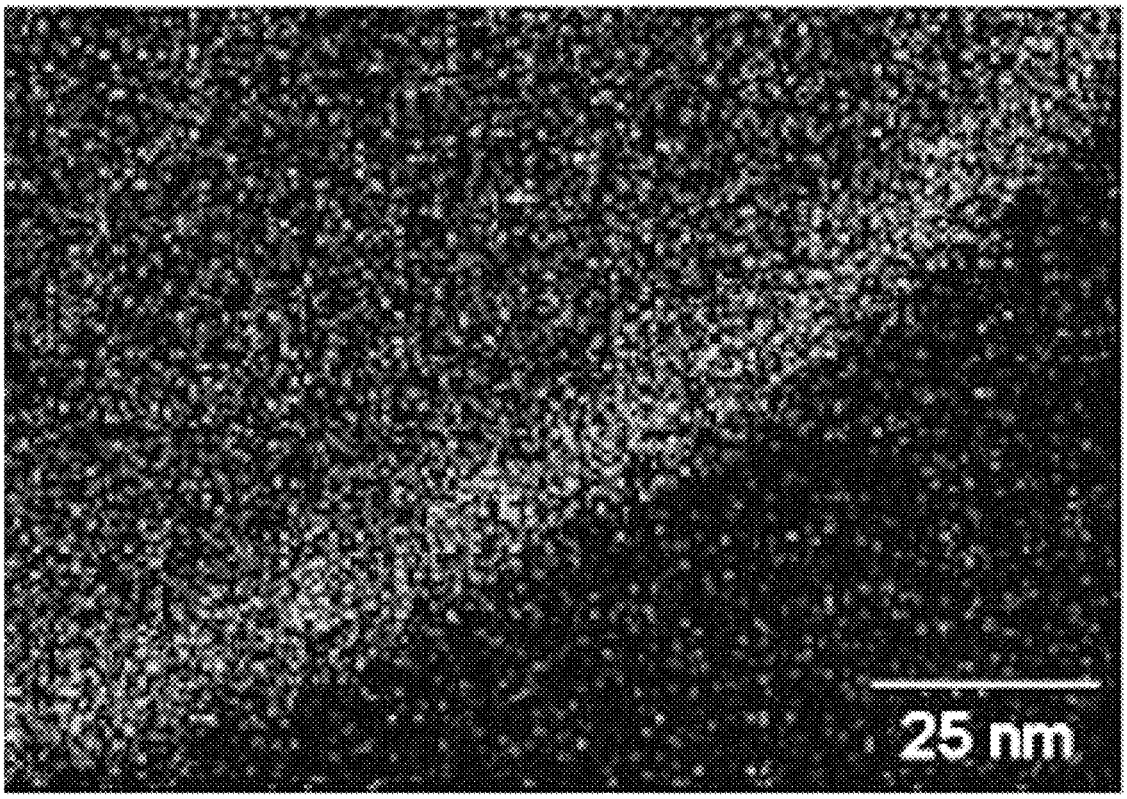

[Fig. 8]
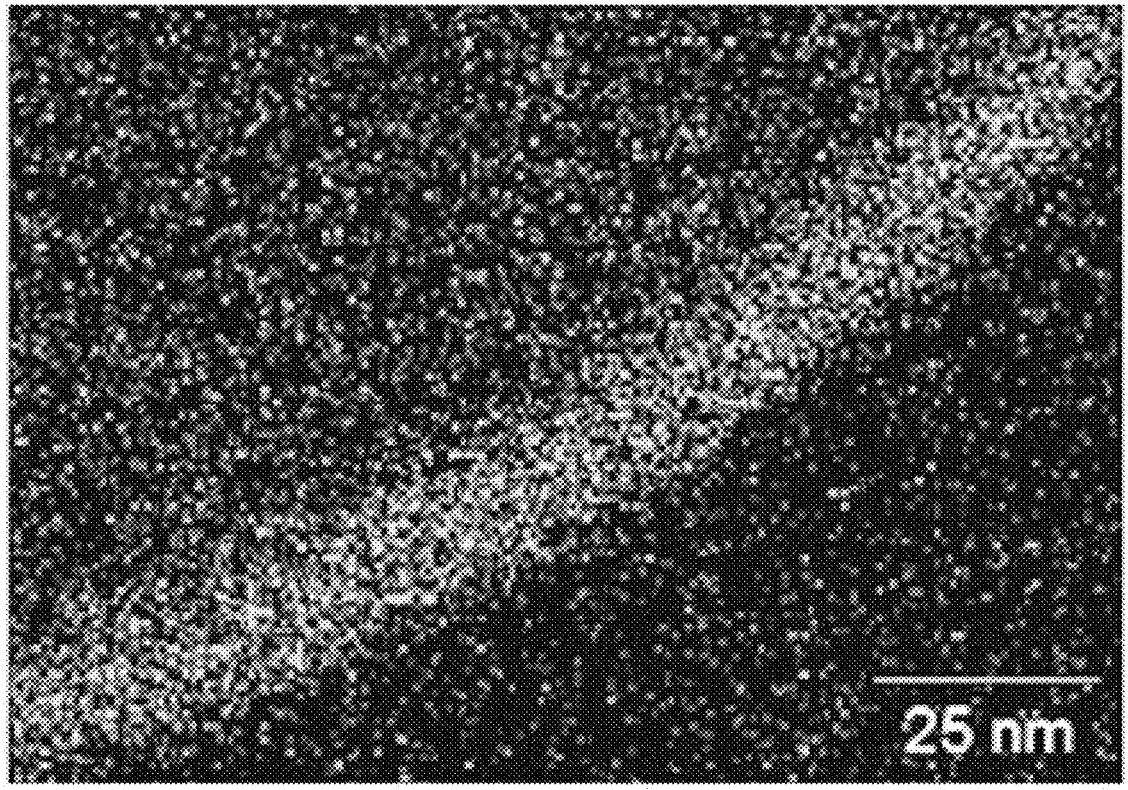

[Fig. 9]
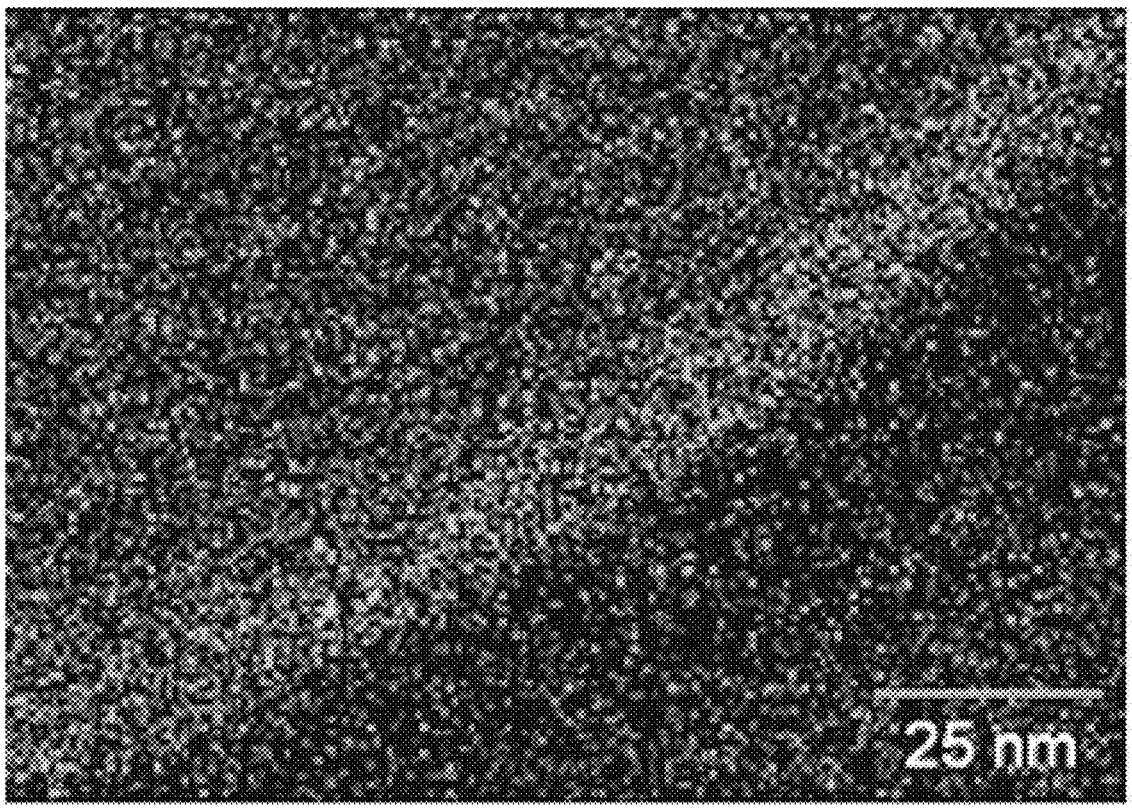

[Fig. 10]
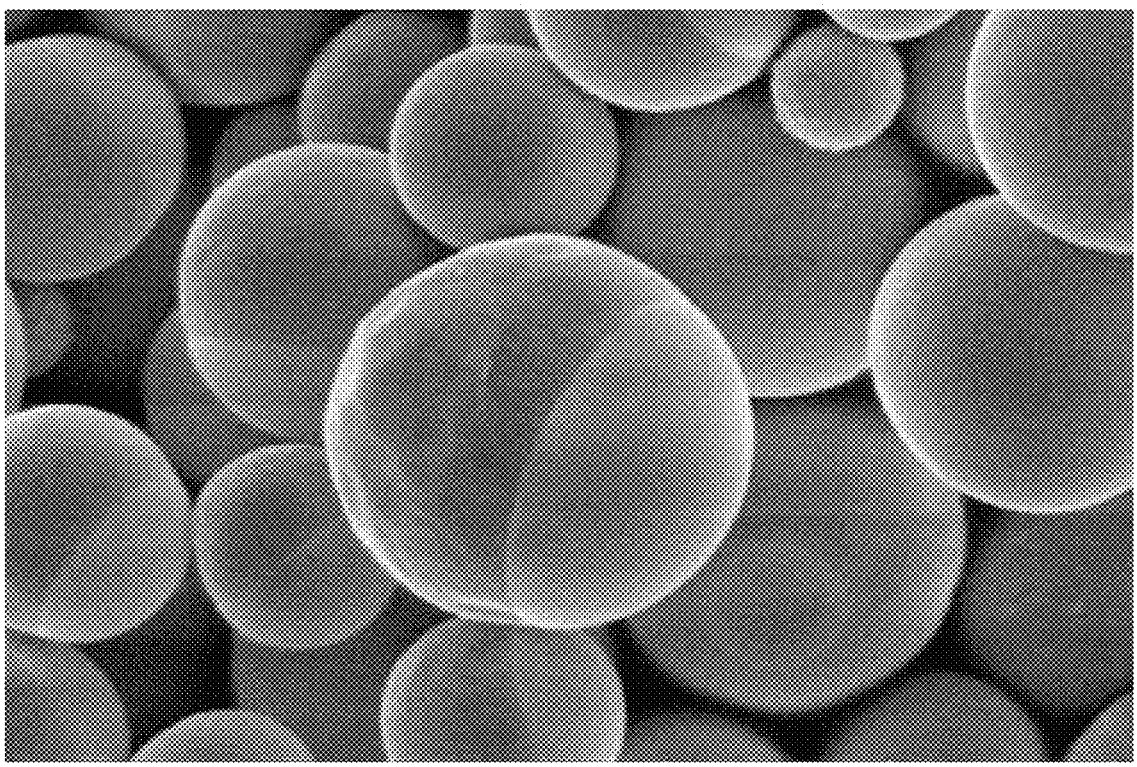

[Fig. 11]
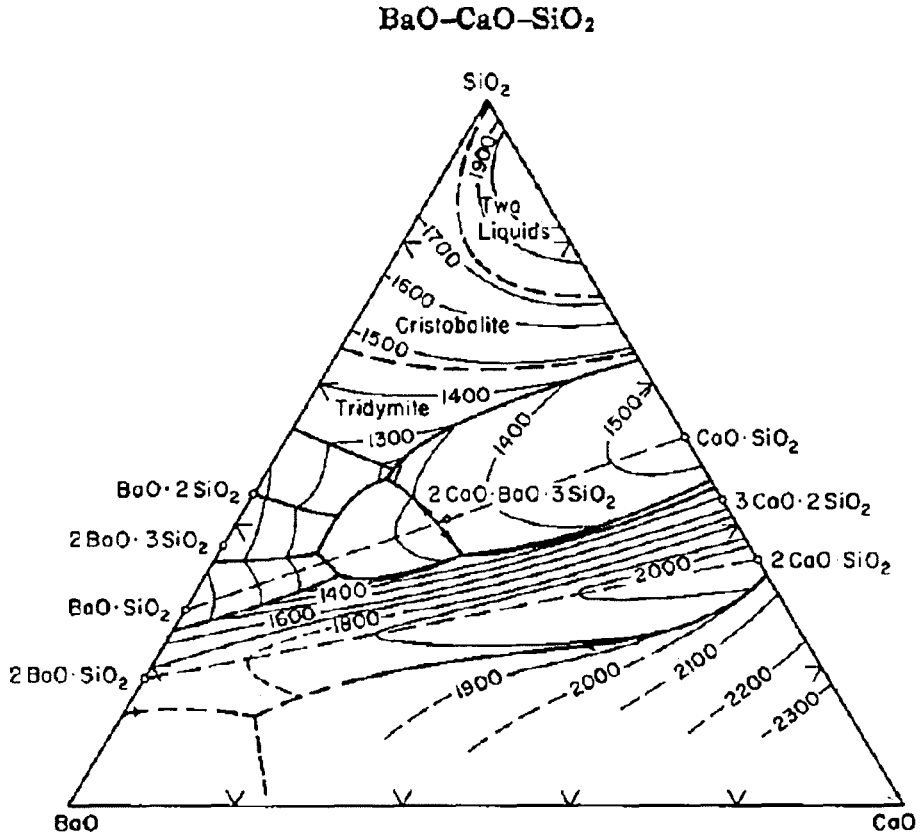
FIG. 549.—System BaO–CaO–$SiO_2$.
N. A. Toropov, F. Ya. Galakhov, and I. A. Bondar, *Izvest. Akad. Nauk S.S.S.R., Otdel. Khim. Nauk.* 1956 [6] 642.
( PRIOR ART )

METHOD FOR PRODUCING METAL POWDER

TECHNICAL FIELD

The present invention relates to a method for producing a metal powder that is coated with a glassy thin film.

BACKGROUND ART

Mobile devices, e.g., notebook computers, smart phones, and so forth, have in recent years undergone substantial reductions in size and weight and a substantial increase in performance. Increasing the frequency of the switched-mode power supply is essential for reducing the size and boosting the performance of these mobile devices, and in association with this the drive frequencies of various magnetic elements, e.g., the choke coil and inductor, incorporated in the mobile devices must also accommodate the frequency increases. However, when the drive frequency of a magnetic element is increased, the problem occurs of an increase in eddy current-based losses in the magnetic cores incorporated in the individual magnetic elements.

The following is therefore done in order to reduce the eddy current losses in the case of use at high frequencies: coating an insulating material on the particle surfaces in a soft magnetic powder to interpose a coating layer of the insulating material between the individual particles, thereby cutting off, between the particles, the eddy current produced in the magnetic core.

For example, PL 1 discloses a soft magnetic powder having a surface coated with an inorganic insulating layer and a resin particle layer. This soft magnetic powder is obtained by forming an inorganic insulating layer including a low-melting-point glass on the surface of a soft magnetic powder—by the application to a preliminarily prepared soft magnetic powder of a powder coating method such as mechanofusion, a wet method such as electroless plating or a sol-gel procedure, or a dry method such as sputtering—and subsequent to this mixing a resin powder with the soft magnetic powder on which the inorganic insulating layer has been further formed.

PL 2 discloses a method for producing a composite-coated soft magnetic powder wherein a coating layer in which boron nitride predominates is formed, using inexpensive materials, on the surface of a ferrous soft magnetic powder. Specifically, a mixed powder is obtained by mixing a preliminarily prepared iron oxide powder, silicon carbide powder, carbon powder, and borosilicate glass powder using, for example, a mixer, and this mixed powder is heated at 1,000 to 1,600° C. in a nitrogen-containing nonoxidizing atmosphere to form a boron nitride layer produced by the decomposition of the borosilicate glass and a metal oxide layer on the surface of an Fe—Si alloy powder.

However, in the preliminary preparation of the soft magnetic powder in the methods of PL 1 and PL 2 for producing a coated soft magnetic powder, the particle diameter and/or particle size distribution of the preliminarily prepared soft magnetic powder must be adjusted into a suitable range depending on the circumstances. In addition, the composition of the insulator that will be coated, as well as the amount of coating, must be controlled in the coating step for forming the insulating layer on the surface. As a consequence, it has been all but impossible to form a uniform and homogeneous insulating layer on the surface of a soft magnetic powder.

As described in PL 3 and PL 4, soft magnetic powders as such have generally been prepared by a heretofore known gas atomization method, mechanical pulverization method, or gas phase reduction method.

On the other hand, spray pyrolysis is known as a method for producing the metal powders used mainly in conductive pastes.

PL 5, PL 6, and PL 7 disclose art in which a solution containing one or two or more thermally decomposable metal compounds is sprayed to convert the solution into microfine droplets and these droplets are heated to a temperature higher than the decomposition temperature of the metal compound, or are heated desirably at around or above the melting point of the metal, to thermally decompose the metal compound and produce metal particles. These spray pyrolysis methods can produce a metal powder that exhibits a good crystallinity, a high density, and a high dispersion performance and also support facile control of the particle diameter. In addition, spray pyrolysis offers the important advantage of enabling the formation of a coating layer on the metal powder surface at the same time as production of the metal powder; this is achieved by the addition, to the metal compound solution that is the starting material for the target metal powder, of a precursor for, e.g., a metal or semimetal poorly solid-soluble in the metal powder or the oxide of such a metal or semimetal. This is thought to occur as follows: since the metal powder yielded by spray pyrolysis has a good crystallinity and few defects in the particle interior and is almost entirely free of grain boundaries, the coating material produced by thermal decomposition is inhibited from being produced in the interior of the metal powder and is forced out to the particle surface, thereby produced at high concentrations in the vicinity of the surface. In addition, since the composition of the product basically conforms to the composition of the metal compound in the solution, it is also easy to control the composition of not only the metal powder but also the coating layer.

For these reasons, metal particles having a coating layer on the surface can be produced by spray pyrolysis without requiring a separate coating step. For example, PL 8, filed by the present applicant, describes an invention in which a metal powder having a glassy thin film coated on at least a portion of the surface is produced by spray pyrolysis without the introduction of a separate coating step.

CITATION LIST

Patent Literature

PL 1: WO 2005/015581 (Japanese Patent No. 4452240)

PL 2: Japanese Patent Application Laid-open No. 2014-192454

PL 3: Japanese Patent Application Laid-open No. H09-256005

PL 4: Japanese Patent Application Laid-open No. 2003-49203

PL 5: Japanese Examined Patent Publication No. S63-31522

PL 6: Japanese Patent Application Laid-open No. H06-172802

PL 7: Japanese Patent Application Laid-open No. H06-279816

PL 8: Japanese Patent Application Laid-open No. H10-330802 (Japanese Patent No. 3206496)

SUMMARY OF INVENTION

Technical Problem

The metal powder described in PL 8 is used mainly in conductive pastes for forming a conductor layer in laminated ceramic electronic components and in particular is a metal powder having a surface coated with a glassy thin film for the purpose of improving the oxidation resistance of the metal powder during firing of the conductive paste. As a consequence, as long as an amount effective for this purpose is attached, there is no need for the glassy thin film to coat the entire metal powder surface and the coating of at least a portion of the metal surface is sufficient.

According to investigations by the present inventors, the production method described in PL 8 can produce a wide variety of glassy thin film-coated metal powders using a large number of glass composition/metal species combinations. On the other hand, there are instances with this method where it is not necessarily easy to obtain a metal powder in which the surface is uniformly coated with a glassy thin film, and with at least some metal species it has not been possible to carry out metal particle production or a uniform coating of the metal particle surface with a glassy thin film and a tendency has been seen for the glassy thin film to be locally deposited only on a specific portion of the metal powder surface. In such cases, improvements are obtained as various control parameters, i.e., the furnace heating temperature and atmosphere and the cooling conditions, are more strictly controlled, but it is more difficult to strictly control the control parameters as the number of parameters to be controlled increases.

According to investigations by the present inventors, the trends described above were observed to a pronounced degree in particular when the metal powder was a soft magnetic powder containing iron (Fe).

With respect to spray pyrolysis, an object of the present invention is therefore to provide a production method that, regardless of the metal species, readily yields a metal powder that has a uniform and homogeneous glassy thin film over the entire surface without local deposition of the glassy thin film on a specific portion of the metal powder surface.

Solution to Problem

The present invention, which addresses the aforementioned problem, is a method for producing a metal powder provided on the surface thereof with a glassy thin film, wherein a solution that contains a thermally decomposable metal compound and a glass precursor that produces a glassy substance that does not form a solid solution with the metal produced from the metal compound by thermal decomposition is converted into microfine droplets, and the droplets are heated, while they are dispersed in a carrier gas, at a temperature higher than the decomposition temperature of the metal compound, higher than the decomposition temperature of the glass precursor, and higher than the melting point of the metal produced from the metal compound, to produce a metal powder containing the metal and produce a glassy substance in the vicinity of the surface of the metal powder, wherein the glass precursor is prepared such that the melting temperature $Tm_M$ of the metal and the liquid phase temperature $Tm_G$ of the mixed oxide of the glassy substance satisfy the following formula (1).

$$-100[^\circ\ C.] \leq (Tm_M - Tm_G) \leq 500[^\circ\ C.] \quad (1)$$

Advantageous Effects of Invention

In accordance with the present invention, a metal powder having a glassy thin film with a uniform film thickness and a glass composition and so forth that is homogeneous can be relatively easily obtained without strict control of a large number of complex control parameters.

BRIEF DESCRIPTION OF DRAWINGS

FIG. 1 is a transmission electron microscope (TEM) image that shows an image of an entire particle in a metal powder provided with a glassy thin film on the surface in accordance with the present invention.

FIG. 2 is a TEM image that shows a portion of the particle in FIG. 1.

FIG. 3 shows the results of line analysis for the particle in FIG. 2.

FIG. 4 is a TEM image that shows a portion of the particle in FIG. 1.

FIG. 5 shows the results of element mapping on FIG. 4 for nickel.

FIG. 6 shows the results of element mapping on FIG. 4 for iron.

FIG. 7 shows the results of element mapping on FIG. 4 for barium.

FIG. 8 shows the results of element mapping on FIG. 4 for silicon.

FIG. 9 shows the results of element mapping on FIG. 4 for oxygen.

FIG. 10 is a TEM image that shows a particle surface according to Experimental Example 17.

FIG. 11 is an equilibrium phase diagram (as mass %) for BaO—CaO—$SiO_2$ glass, as an example of an equilibrium phase diagram.

DESCRIPTION OF EMBODIMENTS

The reason is unclear as to why, in the spray pyrolysis method described in PL 8, a tendency is observed for some glass composition/metal species combinations wherein the glassy thin film is prone to be locally deposited only on a specific portion of the metal powder surface. However, this tendency was strongly observed when in particular the metal powder is a soft magnetic powder that contains iron (Fe). The present inventors carried out a variety of additional tests and hypothesized that the following, for example, could be contributing factors: generally, many metals including iron have high melting points; the iron-containing compounds used as a starting material include many compounds that are resistant to reduction; and many metals including iron exhibit a relatively poor wettability with glass. The present invention was achieved as a result of intensive research based on these hypotheses.

[Metal Powder]

There are no particular limitations on the metal powder in the present invention, and the metal powder in the present invention encompasses the powder of a single metal and the powder of an alloy. However, the operation and effect of the present invention accrue to a greater degree in the case of the production of a metal powder having a relatively high melting point. The melting point ($Tm_M$) of the metal is thus preferably at least 900° C. and is particularly preferably at least 1100° C.

The metal preferably contains iron and is particularly preferably a nickel-iron alloy containing nickel and iron. The nickel and iron contents are not particularly limited, but the mass ratio between the nickel and iron is preferably in the range nickel:iron=40:60 to 85:15, whereamong a permalloy (nickel-iron alloy with a nickel content of around 78.5 mass %) provides a high magnetic permeability and is thus advantageous for the present invention.

Unless specifically indicated otherwise, in the present Specification a numerical value range that is given using "to" indicates a range that includes the numerical values given before and after the "to". In addition, "major component" refers to a component for which the content exceeds 50 mass %.

The nickel-iron alloy may also contain a metal such as molybdenum, copper, chromium, and so forth.

There are no particular limitations on the particle diameter of the metal powder, but the average particle diameter is preferably approximately 0.2 to 20 μm.

[Glassy thin Film]

The glassy substance (also referred to simply as glass) constituting the glassy thin film may be amorphous or may contain crystals in an amorphous film, but the difference ($=Tm_M-Tm_G$) between the melting point ($Tm_M$) of the metal and the liquid phase temperature ($Tm_G$), where the components of the glass are considered as a mixture of the oxides (referred to here as the "mixed oxide"), is preferably in the range from −100° C. to 500° C. The present invention thus preferably satisfies the following formula (1).

$$-100[°\ C.] \leq (Tm_M-Tm_G) \leq 500[°\ C.] \quad (1)$$

Coating of the entire metal powder surface with a glassy thin film is readily achieved when the melting point $Tm_M$ of the metal and the liquid phase temperature $Tm_G$ satisfy the aforementioned condition.

When the value of ($Tm_M-Tm_G$) is lower than −100° C., it is difficult for vitrification from the glass starting material (glass precursor) to occur; when greater than 500° C., the fluidity of the produced glass is too high and as a consequence the occurrence of segregation of the glass on the metal powder surface, partial exposure of the surface, and so forth, is facilitated. In either case, coating of the entire surface of the metal powder with a glassy thin film becomes difficult.

($Tm_M-Tm_G$) is more preferably in the range from −80 to 400° C. and is particularly preferably in the range from −50 to 300° C. The present invention thus particularly preferably satisfies the following formula (2).

$$-50[°\ C.] \leq (Tm_M-Tm_G) \leq 300[°\ C.] \quad (2)$$

The liquid phase temperature $Tm_G$ is influenced by the composition of the glassy substance. Thus, in the present invention, the glass starting material (glass precursor) is prepared by determining a glass composition so that the aforementioned condition with respect to the melting point $Tm_M$ of the target metal is satisfied.

According to investigations by the present inventors, for iron-containing metal powders the aforementioned condition with respect to $Tm_M$ and $Tm_G$ can be readily satisfied by using a silicate based glass. The use of a silicate based glass that provides an $SiO_2$ content in the glassy thin film of at least 40 mass % in terms of oxide is particularly favorable for the present invention. $Tm_G$ is preferably at least 900° C. and is particularly preferably at least 1100° C., although this will also vary as a function of the melting temperature $Tm_M$ of the metal.

The silicate based glass preferably contains an alkaline-earth metal and specifically preferably contains at least one selected from the group consisting of MgO, CaO, SrO, and BaO in terms of oxide. The alkaline-earth metal content is particularly preferably at least 20 mass % in terms of oxide.

The liquid phase temperature $Tm_G$ in the present invention can be determined from an equilibrium phase diagram, such as the one shown in FIG. 11 as an example. As necessary, it may otherwise also be determined from the heat absorption behavior in differential thermal analysis (DTA) or differential scanning calorimetry (DSC).

When iron is present in the metal powder in the production method according to the present invention, as indicated below the presence of an iron component in the glassy thin film on the metal powder surface can then also be confirmed. Since a ferrous compound is not used in the glass starting material (precursor), it is thought that the iron component in this glass originates from the iron compound present in the metal compound used as a starting material for the metal powder and diffuses into the glass during heating. In addition, the present inventors hypothesize that the wettability between the glass and the iron component in the metal powder is improved by the presence of the iron component in the glass, which as a result enables the formation of a strong glass coating film even on an iron-containing metal powder.

[Spray Pyrolysis]

The metal powder according to the present invention is produced by spray pyrolysis. In specific terms, the present invention is a method for producing a metal powder provided on the surface thereof with a glassy thin film, wherein a solution that contains a thermally decomposable metal compound and a glass precursor that produces a glassy substance that does not form a solid solution with the metal produced from the metal compound by thermal decomposition is converted into microfine droplets, and the droplets are heated, while they are dispersed in a carrier gas, at a temperature higher than the decomposition temperature of the metal compound, higher than the decomposition temperature of the glass precursor, and higher than the melting point of the metal produced from the metal compound, to produce a metal powder containing the metal and to produce a glassy substance in the vicinity of the surface of the metal powder.

A complex salt or double salt or one or two or more thermally decomposable salts, e.g., a nitrate salt, sulfate salt, chloride, ammonium salt, phosphate salt, carboxylate salt, or resin acid salt of a metal or a metal alcoholate may be used in the present invention as the thermally decomposable metal compound that is the starting compound for the metal particles. When a mixture of two or more metal salts is used, an alloy particle or mixed particle of two or more metals can then be obtained. One or two or more glass-forming glass precursors are added to a solution of this major component metal compound dissolved in water, an organic solvent such as acetone or an ether, or a mixed solvent of the preceding.

There are no limitations on the glass precursor other than that, under the metal particle production conditions according to the present method, the glass precursor should undergo vitrification and the oxide (glass) produced by thermal decomposition should not go into solid solution in the metal particle. A suitable selection from, for example, the following can be used as the glass precursor: boric acid, silicic acid, and phosphoric acid; thermally decomposable salts, e.g., various borates, silicates, and phosphates as well as the nitrates, sulfates, chlorides, ammonium salts, phosphate salts, carboxylate salts, alcoholates, and resin acid salts of various metals; double salts; and complex salts.

In the present invention, the mixed solution of the metal compound and glass precursor is converted into microfine droplets using a spray device, e.g., an ultrasound type or a dual-flow nozzle type, and this is followed by thermal decomposition by heating to a temperature higher than the decomposition temperature of the metal compound and the decomposition temperature of the glass precursor. When a mixture of two or more compounds is used for the metal compound, heating is carried out at a temperature higher than the decomposition temperature of the metal compound having the highest decomposition temperature.

The heat treatment in the present invention is carried out at a high temperature at or above the melting point of the majority component metal. While the effect of forcing out the glass component can be obtained even at a heating temperature lower than the melting point, in such cases a metal powder having a good crystallinity is not obtained, and in addition the metal powder has an irregular shape, which may lead to an inadequate densification and dispersibility.

The atmosphere during heating is selected as appropriate from oxidizing atmospheres, reducing atmospheres, and inert atmospheres in conformity with, for example, the species of metal compound, the species of glass precursor, the heating temperature, and so forth, but is particularly preferably a reducing atmosphere when a metal powder is being produced for which a base metal is the major component of the metal. In such a case, the addition to the solution is preferably made in advance of a reducing agent that is soluble in the solution and that does not exhibit a reducing activity in the absence of heating (for example, during preparation of the spray solution) and exhibits a reducing activity only during heating. The reducing agent can be exemplified by at least one selected from the group consisting of methanol, ethanol, propanol, ethylene glycol, propylene glycol, diethylene glycol, and tetraethylene glycol. The base metal is not particularly limited, but iron, cobalt, nickel, copper, and so forth are preferred and iron, nickel, and alloys containing them are particularly preferred in the present invention.

While this will depend on the species of metal compound used, the amount of the reducing agent added to the solution is preferably 5 to 30 mass % of the whole of the solution.

While larger amounts of reducing agent are advantageous for reducing the metal compound, this causes an increase in the concentration of the solution and thus impedes spraying in the case of spray pyrolysis. When the amount of reducing agent added to the solution is in the range indicated above, much of the metal compound can be reduced even in the case of use of a metal compound resistant to reduction, while in addition there are no impediments to spraying of the solution.

In addition to the use of the aforementioned reducing agent, in the present invention it is preferable that a reducing gas is optionally present in the range of 1 to 20 volume % in the carrier gas that transports the microfine droplets. The reducing gas can be exemplified by at least one selected from the group consisting of hydrogen, carbon monoxide, methane, and ammonia gas. Through the incorporation of a reducing gas in the carrier gas in combination with the incorporation of a reducing agent in the solution, particularly even in the case of the use of a metal compound resistant to reduction, spray pyrolysis can be carried out while easily controlling reduction without having to increase the amount of reducing agent in the solution and thus without causing impediments to spraying of the solution.

The present invention, because it produces a metal powder by spray pyrolysis from a mixed solution starting material, can yield a target metal powder having a glassy thin film on the surface through the selection of the composition of the individual components, i.e., the thermally decomposable metal compound and the glass precursor, and the amount of addition of the glass precursor relative to the metal compound. The total content of the thermally decomposable metal compound and the glass precursor in the mixed solution is less than 500 g/L as the total concentration in the mixed solution of the two components as the amount of metal components produced from the metal compound by thermal decomposition and the amount of glass components in terms of oxide produced from the glass precursor by thermal decomposition. This total content is advantageously 20 to 100 g/L from the standpoint of the ease of control. When a metal powder particle containing two or more metals is produced using a metal compound that contains two or more metals or using two or more metal compounds, the aforementioned amount of metal components is then the total amount of metal components produced from the metal compound(s) by thermal decomposition. The mixing ratio between the metal compound and glass precursor in the mixed solution is determined by the mass ratio of the amount of glass components in terms of oxide relative to the amount of metal components that will be provided by spray pyrolysis. No effect occurs when the amount of glass components in terms of oxide produced from the glass precursor relative to the amount of metal components produced from the metal compound is smaller than 0.1 mass %. When, on the other hand, the amount of glass precursor addition is too large, the glass produced from the glass precursor is produced segregated to only a portion of the metal particle surface and the uniform coating of the entire particle surface with the glassy thin film becomes difficult. Thus, while this also depends on the density of the produced glass, from a practical perspective the glass precursor is added so as to provide 0.1 to 20 mass % as the aforementioned amount of glass components in terms of oxide relative to the aforementioned amount of metal components, while an addition that provides 0.5 to 15 mass % is particularly desirable. The production method according to the present invention makes it possible to easily obtain metal powder particles that are uniformly coated over the entire surface with a homogeneous glassy thin film; however, the production may also occur to a very small extent of metal powder particles that are provided with a glassy thin film that is slightly nonuniform to a degree that is not problematic at a practical level. The metal powder provided by the production according to the present invention does not exclude such a powder that is not problematic at a practical level.

The present invention is specifically described below using examples, but the present invention is not limited to or by these examples.

EXAMPLES

Experimental Example 1

Nickel nitrate hexahydrate and iron nitrate were weighed out so as to provide the metal shown in Table 1 and were dissolved in water to provide the metal component concentration in the solution also shown in the same table. The following were added to this with mixing to produce a starting solution: ethylene glycol (MEG) as a reducing agent and tetraethyl orthosilicate (TEOS) and barium nitrate that had been weighed out to provide the glass component shown in Table 1 [The numerical values for the glass composition in the table give the content proportion in mass % with respect to the total mass when converted to the oxide. In addition, the amount of added glass components in the table is the amount (mass %) of glass components in terms of oxide with respect to the amount of the metal components; this also applies to Tables 2 and 3.]. The metal component concentration (g/L) in the solution shown in Table 1 and Tables 2 and 3 is the metal compound content per 1 L of solution, as the metal components produced from the metal compound by thermal decomposition. In addition, the amount of reducing agent in the solution given in Table 1 and Tables 2 and 3 is the content (mass %) of the reducing agent with respect to the solution as a whole.

The starting solution was converted into microfine droplets using an ultrasound spray device and, using nitrogen gas as the carrier at the flow rate given in Table 1, was fed into a ceramic tube heated to 1550° C. in an electric furnace. The droplets were thermally decomposed while passing through a heating zone and were collected in the form of a powder.

According to the results of X-ray diffraction, the collected powder was a nickel-iron alloy powder, and diffraction lines other than this were not detected. When this powder was washed with 5% dilute hydrochloric acid, the amount of added material in the powder after washing was substantially depleted while there was almost no dissolution of the nickel or iron.

FIG. 1 is a TEM image that shows an image of an entire particle in the powder immediately after collection. FIG. 3 gives the results for line analysis of this powder in the direction of the arrow in FIG. 2 using energy-dispersive X-ray analysis (EDX). While powder with a small particle diameter is seen in FIG. 1, a powder with a more uniform particle diameter can be obtained as necessary by carrying out a classification process thereon.

FIGS. 5 to 9 give the mapping results for each of the elements nickel, iron, barium, silicon, and oxygen, respectively, from the TEM image of the powder given in FIG. 4. These analyses demonstrated for this powder that silicon and barium were produced at high concentrations on the surface of a nickel-iron alloy powder and were present in the state of BaO—$SiO_2$ glass that is homogeneous and X-ray amorphous. As shown in FIG. 6, the presence of iron in the glassy thin film on the surface of the nickel-iron alloy powder could be confirmed.

The following are given in Table 1: the melting point ($Tm_M$) of the alloy, the liquid phase temperature ($Tm_G$) determined from the equilibrium phase diagram for the mixed oxide for the glass component, the glass coating ratio [%] with respect to the particle surface as determined from the area by element mapping, and the thickness [nm] of the glassy thin film as determined from the TEM image.

TABLE 1

| experimental example | metal | metal component concentration [g/L] | alloy ratio | metal melting point $Tm_M$ [° C.] | glass component | liquid phase temperature $Tm_G$ [° C.] | $Tm_M - Tm_G$ |
|---|---|---|---|---|---|---|---|
| 1 | Ni/Fe | 35 | 78.5/21.5 | 1450 | 33BaO—67$SiO_2$ | 1490 | −40 |
| 2 | Ni/Fe | 35 | 78.5/21.5 | 1450 | 47BaO—53$SiO_2$ | 1400 | 50 |
| 3 | Ni/Fe | 35 | 79.5/20.5 | 1451 | 38BaO—14CaO—48$SiO_2$ | 1190 | 261 |
| 4 | Ni/Fe | 35 | 78.5/21.5 | 1450 | 38BaO—14CaO—48$SiO_2$ | 1190 | 260 |
| 5 | Ni/Fe | 35 | 78.5/21.5 | 1450 | 38BaO—14CaO—48$SiO_2$ | 1190 | 260 |
| 6 | Ni/Fe | 35 | 78.5/21.5 | 1450 | 38BaO—14CaO—48$SiO_2$ | 1190 | 260 |
| 7 | Ni/Fe | 35 | 78.5/21.5 | 1450 | 38BaO—14CaO—48$SiO_2$ | 1190 | 260 |
| 8 | Ni/Fe | 35 | 78.5/21.5 | 1450 | 38BaO—14CaO—48$SiO_2$ | 1190 | 260 |
| 9 | Ni/Fe | 35 | 78.5/21.5 | 1450 | 38BaO—14CaO—48$SiO_2$ | 1190 | 260 |
| 10 | Ni/Fe | 35 | 78.5/21.5 | 1450 | 38BaO—14CaO—48$SiO_2$ | 1190 | 260 |
| 11 | Ni/Fe | 35 | 77.5/22.5 | 1449 | 38BaO—14CaO—48$SiO_2$ | 1190 | 259 |
| 12 | Ni/Fe | 35 | 76.5/23.5 | 1447 | 38BaO—14CaO—48$SiO_2$ | 1190 | 257 |
| 13 | Ni/Fe | 35 | 90/10 | 1452 | 38BaO—14CaO—48$SiO_2$ | 1190 | 262 |
| 14 | Ni/Fe | 35 | 85/15 | 1451 | 38BaO—14CaO—48$SiO_2$ | 1190 | 261 |
| 15 | Ni/Fe | 35 | 45/55 | 1445 | 38BaO—14CaO—48$SiO_2$ | 1190 | 255 |
| 16 | Ni/Fe | 35 | 78.5/21.5 | 1450 | 44BaO—6CaO—51$SiO_2$ | 1300 | 150 |
| 17 | Ni/Fe | 35 | 76.5/23.5 | 1447 | 66$Bi_2O_3$—34MnO | 830 | 617 |

| experimental example | amount of addition of glass components [mass %] | reducing agent in solution | amount of reducing agent in solution [mass %] | carrier gas ($N_2$) flow rate/minute | amount of reducing agent in carrier gas | coating ratio [%] | thickness of glassy thin film [nm] |
|---|---|---|---|---|---|---|---|
| 1 | 2 | MEG | 20 | 80 L/min | — | 100 | 5 |
| 2 | 2 | MEG | 20 | 80 L/min | — | 100 | 5 |
| 3 | 2 | MEG | 20 | 80 L/min | — | 100 | 5 |
| 4 | 0.2 | MEG | 20 | 80 L/min | — | 100 | 1 |
| 5 | 0.5 | MEG | 20 | 80 L/min | — | 100 | 1.5 |
| 6 | 1 | MEG | 20 | 80 L/min | — | 100 | 2 |
| 7 | 2 | MEG | 20 | 80 L/min | — | 100 | 5 |
| 8 | 3 | MEG | 20 | 80 L/min | — | 100 | 7 |
| 9 | 5 | MEG | 20 | 80 L/min | — | 100 | 9 |
| 10 | 10 | MEG | 20 | 80 L/min | — | 100 | 12 |
| 11 | 2 | MEG | 20 | 80 L/min | — | 100 | 5 |
| 12 | 2 | MEG | 20 | 80 L/min | — | 100 | 5 |
| 13 | 2 | MEG | 20 | 80 L/min | — | 100 | 5 |
| 14 | 2 | MEG | 20 | 80 L/min | — | 100 | 5 |
| 15 | 2 | MEG | 20 | 80 L/min | — | 100 | 5 |
| 16 | 2 | MEG | 20 | 80 L/min | — | 100 | 5 |
| 17 | 2 | MEG | 10 | 80 L/min | — | not greater than 50 | not measured |

Experimental Example 2

A nickel-iron alloy powder coated with a BaO—$SiO_2$ glassy thin film was obtained as in Experimental Example 1 except that the glass components were as described in Table 1. The analytic results, obtained as in Experimental Example 1, are given in Table 1.

Experimental Examples 3 to 17

Nickel-iron alloy powders coated with a glassy thin film were obtained as in Experimental Examples 1 and 2 except that for each experimental example the metal composition, glass components, amount of added glass components, and amount of reducing agent added to the solution [content (mass %) of the reducing agent with respect to the entire solution] are set as indicated in Table 1. Calcium nitrate was used as the calcium source for the glass components; manganese nitrate was used as the manganese source; and bismuth citrate was used as the bismuth source. The analytic results, obtained as in Experimental Example 1, are given in Table 1.

As shown in FIG. 10 for Experimental Example 17, a situation was observed in which the glassy thin film was produced segregated to only a portion of the metal powder surface, and for this reason the thickness of the glassy thin film was not measured. It is hypothesized that this result occurred due to the large difference between the melting point $Tm_M$ and the liquid phase temperature $Tm_G$ in Experimental Example 17.

Experimental Examples 18 to 21

Iron powders coated with a glassy thin film were obtained in each of these experimental examples as in Experimental Example 1 except that iron nitrate was used for the metal components, that the procedure was carried out so as to provide the metal components concentration in the solution and the glass components as given in Table 2, and that the reducing agent given in Table 2 was added to the carrier gas. The amount of reducing agent in the solution is, as above, the content (mass %) of the reducing agent with respect to the entire solution. In addition, hydrogen gas and carbon monoxide were added in the amounts (volume %) shown in Table 2 to the nitrogen gas used as a carrier gas. The analytic results, obtained as in Experimental Example 1, are given in Table 2.

A region in which the thickness of the glassy thin film was not uniform was seen on the surface to a very slight degree for the iron powder of Experimental Example 19, but this was still usable at a practical level.

TABLE 2

| experimental example | metal | metal component concentration [g/L] | alloy ratio | metal melting point $Tm_M$ [° C.] | glass component | liquid phase temperature $Tm_G$ [° C.] | $Tm_M - Tm_G$ |
|---|---|---|---|---|---|---|---|
| 18 | Fe | 20 | — | 1538 | 33BaO—67$SiO_2$ | 1490 | 48 |
| 19 | Fe | 20 | — | 1538 | 38BaO—14CaO—48$SiO_2$ | 1190 | 348 |
| 20 | Fe | 20 | — | 1538 | 38BaO—14CaO—48$SiO_2$ | 1190 | 348 |
| 21 | Fe | 20 | — | 1538 | 38BaO—14CaO—48$SiO_2$ | 1190 | 348 |

| experimental example | amount of addition of glass components [mass %] | reducing agent in solution | amount of reducing agent in solution [mass %] | carrier gas ($N_2$) flow rate/minute | amount of reducing agent in carrier gas | coating ratio [%] | thickness of glassy thin film [nm] |
|---|---|---|---|---|---|---|---|
| 18 | 2 | MEG | 20 | 80 L/min | 4% $H_2$, 12.5% CO | 100 | 5 |
| 19 | 2 | MEG | 20 | 80 L/min | 4% $H_2$, 12.5% CO | 100 | 3~5 |
| 20 | 2 | MEG | 25 | 80 L/min | 3% $H_2$ | 100 | 5 |
| 21 | 2 | MEG | 15 | 80 L/min | 5.5% $H_2$, 12.5% CO | 100 | 5 |

Experimental Examples 22 to 26

Metal powders coated with a glassy thin film were obtained as in Experimental Example 1, except that the metal composition, the metal component concentration in the solution, the glass components, and the reducing agent added to the solution [the amount of reducing agent in the solution is the content (mass %) with respect to the overall solution] are changed in accordance with Table 3. Tetraethylene glycol (TEG) was used as the reducing agent in Experimental Example 22, while, as in Experimental Example 1, MEG was used in Experimental Examples 23 to 25. No reducing agent was used in Experimental Example 26. The analytic results, obtained as in Experimental Example 1, are given in Table 3.

TABLE 3

| experimental example | metal | metal component concentration [g/L] | alloy ratio | metal melting point $Tm_M$ [° C.] | glass component | liquid phase temperature $Tm_G$ [° C.] |
|---|---|---|---|---|---|---|
| 22 | Ni | 40 | — | 1455 | 35.2BaO—14.3CaO—45.7$SiO_2$—4.8MnO | 1145 |
| 23 | Cu/Ni | 60 | 85/15 | 1170 | 35.2BaO—14.3CaO—45.7$SiO_2$—4.8MnO | 1145 |
| 24 | Cu/Ni | 60 | 90/10 | 1150 | 35.2BaO—14.3CaO—45.7$SiO_2$—4.8MnO | 1145 |
| 25 | Cu | 40 | — | 1085 | 35.2BaO—14.3CaO—45.7$SiO_2$—4.8MnO | 1145 |
| 26 | Ag | 40 | — | 962 | 66$Bi_2O_3$—34MnO | 830 |

| experimental example | $Tm_M - Tm_G$ | amount of addition of glass components [mass %] | reducing agent in solution | amount of reducing agent in solution [mass %] | carrier gas ($N_2$) flow rate/minute | amount of reducing agent in carrier gas | coating ratio [%] | thickness of glassy thin film [nm] |
|---|---|---|---|---|---|---|---|---|
| 22 | 310 | 2 | TEG | 8 | 80 L/min | — | 100 | 5 |
| 23 | 25 | 2 | MEG | 10 | 80 L/min | — | 100 | 5 |
| 24 | 5 | 2 | MEG | 10 | 80 L/min | — | 100 | 5 |
| 25 | −60 | 2 | MEG | 10 | 80 L/min | — | 100 | 5 |
| 26 | 132 | 2 | — | — | 80 L/min | — | 100 | 5 |

The invention claimed is:

1. A method for producing a metal powder containing iron provided on a surface thereof with a glassy thin film in which iron is present, the method comprising:

converting a solution into droplets, wherein the solution contains a thermally decomposable metal compound comprising an iron compound and a glass precursor that produces a glassy substance that does not form a solid solution with a metal produced from the thermally decomposable metal compound by thermal decomposition; and heating the droplets in a reducing atmosphere, while the droplets are dispersed in a carrier gas, at a temperature higher than a decomposition temperature of the thermally decomposable metal compound, higher than a decomposition temperature of the glass precursor, and higher than a melting point of the metal produced from the thermally decomposable metal compound, to produce the metal powder comprising the metal and to produce the glassy substance on the metal powder surface, wherein the solution contains 5 to 30 mass %, with reference to an overall solution, of a reducing agent that is soluble in the solution and exhibits a reducing activity during the aforementioned step of heating, the glassy substance comprises a silicate-based glass and contains at least 40 mass % of $SiO_2$ in terms of oxide, the iron in the glassy thin film originates from the iron compound, and the glass precursor is prepared such that a melting temperature ($Tm_M$) of the metal and a liquid phase temperature ($Tm_G$) of a mixed oxide of the glassy substance satisfy the following formula:

$$-50[°\ C.] \leq (Tm_M - Tm_G) \leq 300[°\ C.].$$

2. The method according to claim 1, wherein the melting temperature $Tm_M$ and the liquid phase temperature $Tm_G$ are both at least 1100° C.

3. The method according to claim 1, wherein the reducing agent comprises at least one selected from the group consisting of methanol, ethanol, propanol, ethylene glycol, propylene glycol, diethylene glycol, and tetraethylene glycol.

4. The method according to claim 1, wherein the total content in the solution of the thermally decomposable metal compound comprising the iron compound and the glass precursor is 20 to 100 g/L as a total concentration of the two components as an amount of metal components produced from the thermally decomposable metal compound by thermal decomposition and an amount of glass components in terms of oxide produced from the glass precursor by thermal decomposition.

5. The method according to claim 1, wherein the metal comprises nickel and iron.

6. The method according to claim 5, wherein a mass ratio between the nickel and iron is nickel:iron=40:60 to 85:15.

7. The method according to claim 1, wherein the glassy substance contains at least one selected from MgO, CaO, SrO, and BaO in terms of oxide.

8. The method according to claim 1, wherein 1 to 20 volume % of a reducing gas is present in the carrier gas.

9. The method according to claim 8, wherein the reducing gas is at least one selected from hydrogen, carbon monoxide, methane, and ammonia gas.

* * * * *